United States Patent [19]

Poncy

[11] 4,136,776

[45] Jan. 30, 1979

[54] DISPOSABLE THERMOMETER SHEATH PACKAGE

[76] Inventor: George W. Poncy, 12540 U.S. 1, North Palm Beach, Fla. 33408

[21] Appl. No.: 797,385

[22] Filed: May 16, 1977

[51] Int. Cl.[2] ..... B65D 85/38

[52] U.S. Cl. ..... 206/306; 206/484; 206/610; 206/613

[58] Field of Search ..... 206/212, 306, 439, 484, 206/813, 610, 613, 629, 632, 620, 210, 207, 205; 229/62, 53

[56] References Cited

U.S. PATENT DOCUMENTS

| | | | |
|---|---|---|---|
| 2,915,175 | 12/1959 | Diamant | 206/306 |
| 2,976,988 | 3/1961 | Schnieder | 206/484 |
| 3,552,558 | 1/1971 | Poncy | 206/306 |
| 3,554,438 | 1/1971 | Malderghem | 206/632 |
| 3,732,975 | 5/1973 | Poncy | 206/306 |
| 3,752,309 | 8/1973 | Hopkins et al. | 206/306 |
| 3,809,230 | 5/1974 | Poncy | 206/306 |
| 3,835,990 | 9/1974 | Sagi et al. | 206/306 |
| 3,847,280 | 11/1974 | Poncy | 206/212 |
| 3,955,750 | 5/1976 | Huffman | 206/629 |
| 4,026,751 | 5/1977 | Fowler et al. | 206/306 |

*Primary Examiner*—William Price
*Assistant Examiner*—Bruce H. Bernstein
*Attorney, Agent, or Firm*—Lane, Aitken & Ziems

[57] ABSTRACT

A disposable thermometer sheath package contains a sheath to provide a sterile barrier during temperature taking with a clinical thermometer. The sheath package comprises inner strips in which the sheath is formed by a tear seal and outer cover strips. All four strips of the sheath are sealed together in the tab portion thereof along the edges of a tab portion to make the tab portion into a pocket leading to the mouth of the sheath. Additional flat seals are formed between all four strips within the tear seal to provide a restriction within the sheath in order to cause the sheath to turn inside out upon a thermometer being withdrawn. A die is provided to simultaneously make the tear seal and the flat seals. The die surfaces of the flat seal forming portions of the die are offset from the die surface of the tear seal forming portion to permit the tear seal forming portion to sink sufficiently far into the sandwich of strips of the sheath package to properly form the tear seal.

6 Claims, 8 Drawing Figures

DISPOSABLE THERMOMETER SHEATH PACKAGE

REFERENCE TO RELATED APPLICATIONS

This applixation is related to application Ser. No. 550,000, filed Feb. 14, 1975, by the inventor of this application.

BACKGROUND OF THE INVENTION

This invention relates to an improved sheath package containing a sheath primarily designed to function as a sterile shield for clinical thermometers, but may be used with tongue depressors, probes, catheters and other instruments or tools which are required to be sterile when used.

While it is well known that the clinical thermometer used in taking body temperature readings should be in a state of sterility in order to avoid recontamination of the patient in subsequent readings, or contamination of another patient, it is not as well known among laymen that present practices in many hospitals and by many doctors in their private practices do not afford a sterile thermometer. The cross-contamination that can occur when the same thermometer is used on different patients is a constant hazard.

The shortcomings of this practice with regard to sterility of thermometers was well recognized by the medical profession which, while cognizant of the dangers of such practice, did not, until relatively recently, have available a practical and economical means of facilitating the use of a thermometer which is sterile at each use.

The inventions of U.S. Pat. Nos. 3,552,558; 3,732,975; 3,809,230; and 3,847,280, generally provide in a sterile expendable package a sterile disposable sheath for instruments such as clinical thermometers. The package is designed so that a thermometer can readily be inserted by anyone so that the thermometer enters directly into a transparent sheath which has previously been sterilized and maintained in a sterile condition within the package in those areas which come into contact with the body of a patient. The package can be stripped to expose the sterile sheath, whereupon the sheathed thermometer may be inserted into a body cavity, and a reading subsequently taken through the sheath. The sheath can then be discarded, or it may first be discarded, so that the reading can be taken directly from the thermometer.

The thermometer may then, for subsequent use, be inserted into a new package and sheath without the necessity of sterilizing the thermometer itself after each use. This results in a substantial saving of time in the handling of the thermometer, and in the saving of money for the materials and supplies heretofore used to sterilize such objects. The use of such a sterile package will also serve to reduce the total number of thermometers required to be available.

In copending application Ser. No. 550,000, there is disclosed a sheath package similar to those described above with a weakened line in the cover material of the package across substantially the entire width thereof near the mouth of the sheath so that as the cover material is stripped to expose the sheath, it can easily be separated along this weakened line to leave a portion of the cover material as a tab. This tab provides a convenient place to grasp the sheathed thermometer after the cover material has been stripped away in the handling of the sheathed thermometer incidental or necessary to temperature taking. However, in this handling of the sheathed thermometer, the cover material forming part of the tab sometimes comes loose and falls away leaving only an underlying very thin flexible thermoplastic material, from which the sheath is formed, to act as a means of grasping the sheathed thermometer. Because the thin flexible material is relatively slippery, the sheathed thermometer may be dropped and the thermometer broken when the tab consists only of the thin flexible sheath material. If the cover material should come off of the sheath material of the tab in rectal use, the thermometer is sometimes withdrawn without sufficient grasp upon the thin slippery flexible material forming the tab thus leaving the sheath still deposited within the rectal cavity.

SUMMARY OF THE PRESENT INVENTION

In accordance with the present invention, the above described problem is overcome by flat seals along the sides of the portion of the package which forms the tab. The flat seals bond all four layers, including the two layers of the sheath material and the two layers of the cover material, together. The seal provided is a heat seal achieved by melting the two film portions together and into the cover material. These flat seals form a pocket in the tab through which the thermometer is inserted into the sheath.

Additional flat seals in the form of half-moons are formed inside the tear seal to form a constriction inside of the sheath. This constriction makes a press fit with the inserted thermometer so that the sheath will turn inside out when the thermometer is withdrawn. These half-moon flat seals are located about ¾ of an inch from the closed end of the sheath, sufficiently spaced from the closed end so that the person inserting the thermometer into the sheath will not mistakenly believe that the thermometer is fully inserted into the sheath when the thermometer encounters the resistance of the constriction provided by the half-moon seals.

The flat seals in the tab and within the tear seal are formed at the same time that a tear seal is formed to define the sheath in the sheath package. To achieve this simultaneous sealing, a die is employed which includes one portion integrally formed with the base of the die to effect the tear seal, a second die portion separably mounted on the base of the die to effect the flat seals along the sides of the tab, and a third die portion also separably mounted on the base of the die to form the half-moon seals. The second and third die portions are arranged so that their surfaces, which are coplanar, are slightly offset from the die surface of the tear seal forming portion and so that they come into contact with the materials of the sheath package slightly after the tear seal forming portion during the sealing operation. This feature makes it possible for the tear seal forming portion to sink sufficiently far into the materials of the sheath package to form the tear seal. The flat seal forming portions are separably mounted on the die so that the amount that they are offset from the tear seal forming portion can be adjusted for different types of materials to be used in the sheath package.

DETAILED DESCRIPTION OF AN EXEMPLARY EMBODIMENT

Figure 1:
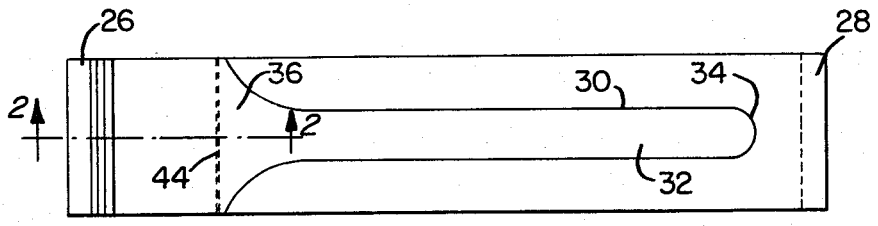
FIG. 1 is a plan view of the sheath package disclosed in the copending application Ser. No. 550,000.
Figure 2:
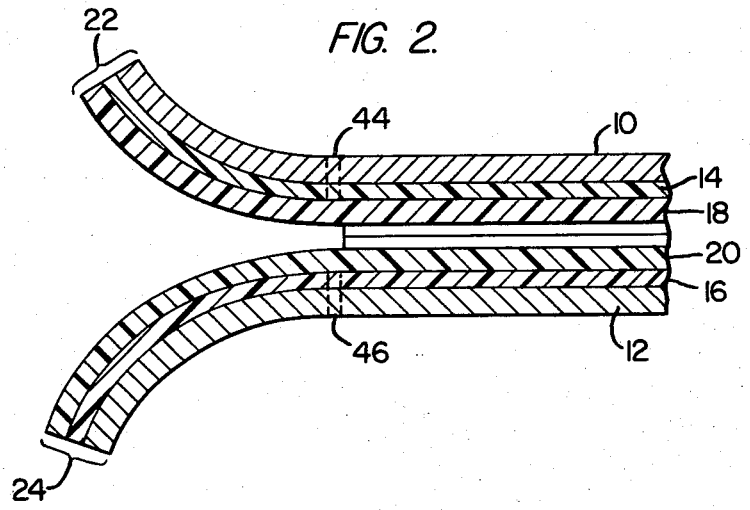
FIG. 2 is a sectional view of a portion of the sheath package of FIG. 1 taken along line 2—2.

In order to provide a clear understanding of the subject invention, the sheath package of application Ser. No. 550,000 will be described. As shown in FIGS. 1 and 2, the sheath package of the above mentioned application is formed of a plurality of layers of material that are joined together by heat sealing. These layers include the outer protective strips 10, 12, respectively, which are formed of thin strips of paper, preferably glassine. Each of the outer strips 10, 12, is coated on its inner surface with a very thin layer of thermoplastic material 14, 16, to form a composite strip. The thickness of the thermoplastic coating is preferably about ½ mil or less. These composite strips taken together will hereinafter be called the cover material.

The sheath package also includes two inner strips 18 and 20, which are formed of thin films or sheets of an impervious, transparent, flexible thermoplastic material, each of which is preferably about 1 mil in thickness. As will become apparent from the following description, these strips are used to form the sheath and will be called the sheath material.

The cover material and sheath material are arranged in two strip assemblies, as shown in FIG. 2, which will be called the upper strip assembly 22 and the lower strip assembly 24. When these assemblies are formed into the package as shown, the ends of the upper strip assembly 22 are preferably offset with respect to the ends of the lower strip assembly 24 so that an end portion 26 of the lower strip assembly 24 projects beyond the end of the strip assembly 22 and an end portion 28 of the upper strip assembly 22 projects beyond the end of the lower strip assembly 24 at the other end of the sheath package.

The cover and sheath materials are joined together along a seal line 30 by means of a die in a high frequency heat sealing press. The line 30 forms the outline of a sheath, which is closed at one end 34 and open at the other end through a flaring or funnel-shaped mouth 36. When the heat sealing die is applied to the assembly of sheath and cover materials, they are all united together along the seal line 30. The sealing of the strips together along the line 30 is accomplished by the flowing together of the thermoplastic material of the coatings 14 and 16 and the strips 18 and 20. The bonding of the strips 18 and 20 along line 30 thus forms a sheath 32 in the strips 18 and 20. The seal formed between the strips 18 and 20 along line 30 is a tear seal. The formation of this tear seal has the effect of weakening the thermoplastic material so that after a thermometer has been inserted in the sheath 32, the sheath material of strips 18 and 20 outside of the line 30 will easily tear along the middle of the seal to leave the sheath 32 remaining around the thermometer.

The coated construction of the strips 10 and 12 of the cover material permits them to be easily separated from the strips 18 and 20 of the sheath material along the seal line 30 with the application of small force. The bond between the strips 18 and 20 along line 30, however, is strong enough to prevent separation of the strips 18 and 20 along the seal line 30, although, as pointed out above, the seal is tearable down the middle thereof to separate the sheath material outside the seal line 30 from the material inside comprising the sheath 32 itself.

A weakened line 44 is provided across the width of the upper strip 10 at or near the mouth 36. The weakened line may be formed by providing a series of perforations or punctures in the upper cover material layer or it may be formed by scoring or otherwise weakening the fibers of the paper strip 10 along the line 44. The bottom cover sheath may also include a weakened line 46 at the same location. The ends of the seal line 30 defining the mouth of the sheath are located very near to the edge of the strips so as to provide a narrow width of thermoplastic material between the ends of the seal and the edges of the thermoplastic material.

The thermoplastic coating 14 of the protective strip 10 is sealed to the thermoplastic sheath material 18 across each end thereof beyond the closed end 34 of the seal line 30 and from a point inward of the mouth 36 to the adjacent end of the strip assembly 22. The thermoplastic coating 16 of the lower cover strip 12 is sealed to the strip 20 across the end of the strip assembly 22 adjacent to the mouth 36 from a point inward of the mouth 36 to the adjacent end of the strip assembly. These sealed areas are provided adjacent to the mouth 36 to prevent bacteria from entering between the cover material and the sheath material at the mouth 36 and contaminating the surface of the sheath 32. The opposite end of the upper strip assembly 22 is sealed together outside the end of the closed end of the seal line 30 so that the materials in the upper strip assembly 22 can be easily grasped as a unit when the sheath is to be exposed for use.

The remaining adjacent portions of the respective cover and sheath material are not sealed together. To use the sheath package shown in FIGS. 1 and 2, a thermometer is inserted into the mouth 36 of the sheath 32, the mouth being open to atmosphere. The end portion 28 is then grasped and peeled back. This action results in the upper cover material and the excess sheath material (the sheath material outside of the line 30) in both the strips 18 and 20 to be separated from the remaining sheath material inside the seal line 30. The separation occurs in this manner because of the nature of the tear seal along the seal line 30. After the upper cover strip 10 and the excess sheath material have been peeled back to the mouth of the seal line, a sharp tug on the strip 10 will result in the clean severance of the cover strip 10 along the weakened line 44 and also of the excess sheath material from the portions of the strips 18 and 20 between the mouth 36 and the adjacent end of the package. The lower cover strip 12 is then peeled back to the mouth 36 and then separated along the weakened line 46. In this manner, the sheath around the thermometer is exposed leaving tabs attached to the sheath in the form of the laminated portions of the upper and lower assemblies 22 and 24 between the weakened lines 44 and 46 and the adjacent ends of these assemblies.

These laminated tabs serve as convenient handles for handling the sheathed thermometer. However, because the bond between the cover material and the sheath material is not strong, the handling of the tabs during temperature taking sometimes causes the cover material of the tabs to come loose from the sheath material and fall away. As a result, the sheathed thermometer has to be handled by holding onto the relatively slippery sheath material of the strips 18 and 20 resulting in the thermometer sometimes being dropped and broken. Also, in rectal use, the sheath is sometimes left in the rectal cavity when the thermometer is withdrawn.

Figure 3:
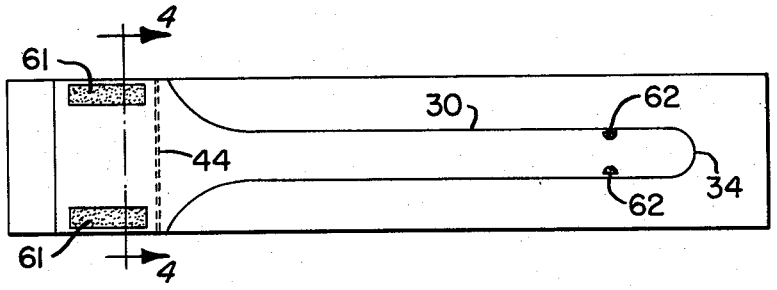
FIG. 3 is a plan view of the sheath package made in accordance with the present invention.
Figure 4:
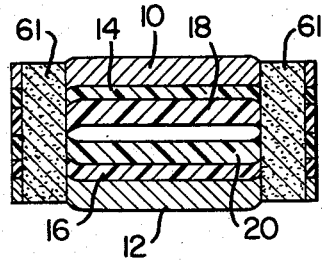
FIG. 4 is a sectional view of the sheath package of FIG. 3 taken along line 4—4.

In accordance with the present invention, this problem with the sheath disclosed in the above mentioned copending application is overcome by means of the embodiment shown in FIGS. 3 and 4. The sheath package in FIGS. 3 and 4 is just like that shown in FIGS. 1 and 2 except additional flat seals wider than the tear seal are provided in the sheath package sealing all four strips of the package together. One pair of linear flat seals 61 are provided along the edges of the portion of the sheath package which forms the tabs. These seals seal the cover material and the inner sheath material sheets all together throughout the width of the package so that the upper assembly 22 is sealed to the lower assembly 24 along these seals, whereas in the prior embodiment of FIGS. 1 and 2, the upper and lower assemblies are not sealed together in the tab portion as illustrated in FIG. 2. An additional pair of flat seals 62 in the shape of half-moons are provided within the seal line 30 adjacent to the seal line 30 with their curved surfaces facing each other. The flat seals are formed by melting the coating 14 and 16 on the cover sheets 10 and 12 together with the material of the inner sheets 18 and 20 causing part of the plastic material to permeate into the cover sheets 10 and 12.

The flat seals 61 provide a pocket in the tab portion through which the thermometer is inserted into the mouth 36. Because all of the strips are sealed together in the tab portion and because the seal material permeates into the outer cover material, the cover material of the tab portion is very firmly held onto the sheath material of the tab portion and will not come off of the sheath material of the tabs as a result of the handling of the tabs during temperature taking.

The half-moon seals 62 provide a restriction which forms a press fit with an inserted thermometer. The seals 62 are located ¾ of an inch from the closed end 34, sufficiently far that the user does not mistakenly believe the themometer is fully inserted when it encounters the resistance of the restriction provided by the seals 62. The press fit between the seals 62 and an inserted thermometer will cause the sheath 32 to turn inside out when the thermometer is removed so as to enclose the soiled outside of the sheath within itself.

Figure 5:
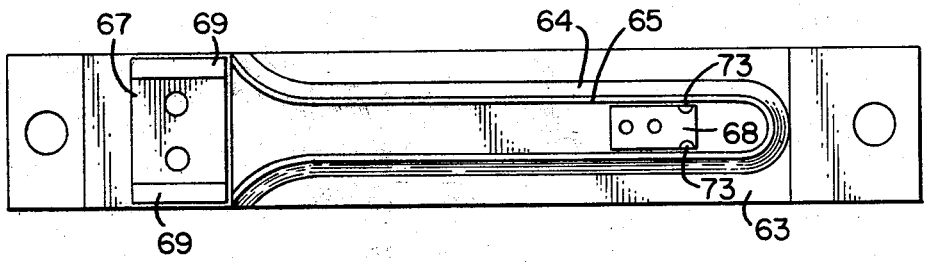
FIG. 5 is a bottom plan view of the die used to make the sheath package of FIG. 3 showing the operative die surfaces.
Figure 6:
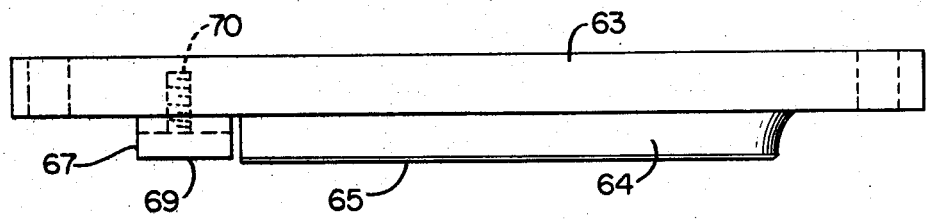
FIG. 6 is a view in elevation of the die shown in FIG. 3.
Figure 7:
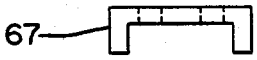
FIG. 7 is a view in elevation of the portion of the die shown in FIGS. 5 and 6 used to make the flat seals in the tab portion of the sheath package.
Figure 8:
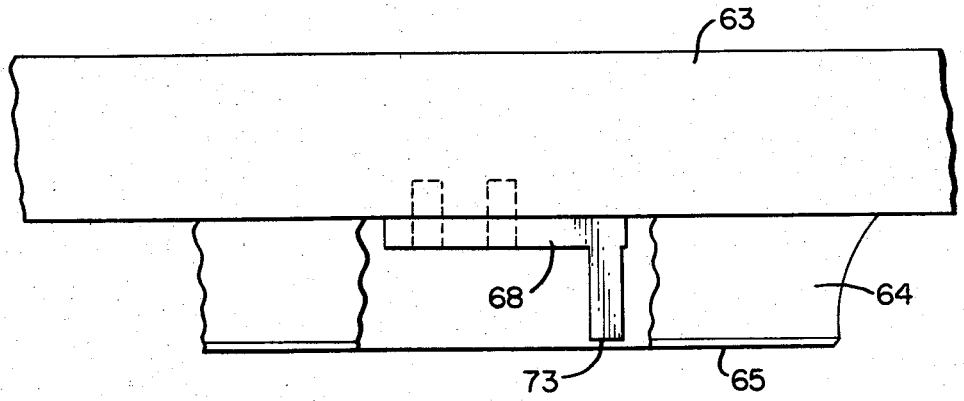
FIG. 8 is a view in elevation of a portion of the die partially broken away to show the die portion which forms the half-moon seals.

FIGS. 5 and 6 illustrate the die which is used to make the tear seal in the sheath package of FIGS. 3 and 4 and which at the same time makes the flat seals 61 and 62. As shown in FIG. 5, the die comprises a base member 63 from which there extends the tear seal forming portion 64 having a die surface 65 with a profile and shape to form the tear seal. Separate die members 67 and 68 are also mounted on the base 63 in position to make the flat seals 61 and 62, respectively. The member 67 is U-shaped and has a base portion which abuts against the surface of the base 63. The member 67 has two legs which extend up from the base to define die surfaces 69 in the shape of the seals 61. The member 67 is secured to a flat surface of the base 63 by screws 70 passing through clearance holes in the base portion of the U-shaped member 67 and tapped into the base 63. The die member 68, which is positioned to make the half-moon seals 62, comprises a flat base portion secured to a flat surface of the base 63 within the tear seal forming portion 64 by means of screws passing through clearance holes in the die member 68 and tapped into the base 63. The die member 68 has two legs terminating in die surfaces 73 in the shape of the half-moon seals 62. The die surface 65 is in a plane and the die surfaces 69 and 73 are also in a plane parallel to the plane of the die surface 65 offset towards the base 63. The width of this offset is on the order of 0.0015 of an inch.

The die material is brass and forms the seal by being brought down on the sandwich of materials comprising the strips 10, 12, 18 and 20 against an electrically conducting base plate and high frequency current is applied between the base plate and the die shown in FIGS. 5 and 6. This causes the tear seal 30 and the flat seals 61 and 62 to be formed. The reason the plane of the die surfaces 69 and 73 are offset from the die surface 65 is so that the die surfaces 69 and 73 will not act as a brake or stop to prevent the die surface 65 from sinking the necessary distance into the sandwich of strip materials and prevent it from properly making the tear seal 30. The reason the die portions 67 and 68 are separately mounted on the base 63 is to permit variations in the offset distance of the plane of the surfaces 69 and 73 from the plane of the surface 65 to accommodate different materials. This variation is achieved by appropriate shims placed underneath the members 67 and 68 to reduce the distance of the offset to the desired value.

The above description is of a preferred embodiment of the invention and modifications may be made thereto without departing from the spirit and scope of the invention which is defined in the appended claims.

I claim:

1. A sheath package comprising a pair of inner strips of flexible thermoplastic material bonded together along a tear seal shaped to form a sheath out of said inner strips with an open mouth and designed to receive an instrument, a pair of cover strips sandwiching said inner strips and bonded to said inner strips, a weakened line extending across the width of said cover strips at the mouth of said sheath, to define a tab portion between said weakened line and the adjacent ends of said strips, said inner strips and said cover strips all being bonded together along the sides of said tab portion to define a pocket in said tab portion between both said bonded sides and said inner strips, said inner strips not being bonded together in said tab portion between said bonded sides of said tab portion from the distal end thereof to the mouth of said sheath so that said pocket provides an opening from the mouth of said sheath to the exterior of the package.

2. A sheath package as recited in claim 1, wherein said cover strips are releasably bonded to said inner strips along said tear seal.

3. A sheath package as recited in claim 1, wherein said cover strips are bonded to said inner strips across the width of said strips in said tab portion.

4. A sheath package as recited in claim 3, wherein said cover strips are releasably bonded to said inner strips along said seal line.

5. A sheath package as recited in claim 1, wherein the inner strips and the cover strips are all bonded together along the sides of said tab portion by heat seals wider than said tear seal.

6. A sheath package as recited in claim 5, wherein said inner strips and said cover strips are all bonded together by flat seals within said tear seal to form a constriction in said sheath at a point spaced from the closed end of said sheath.

* * * * *